US005746317A

United States Patent [19]

Turner et al.

[11] Patent Number: 5,746,317

[45] Date of Patent: May 5, 1998

[54] EVACUATIVE CHRISTMAS TREE CONTAINER

[76] Inventors: Wayne E. Turner; Peggy B. Turner, both of 3300 Highway 2 West, P.O. Box 8240, Kalispell, Mont. 59904

[21] Appl. No.: 870,650

[22] Filed: Jun. 6, 1997

[51] Int. Cl.[6] ..... B65D 85/50

[52] U.S. Cl. ..... 206/423; 206/524.8; 383/907

[58] Field of Search ..... 206/423, 524.8; 383/3, 210, 41, 63, 902, 907

[56] References Cited

U.S. PATENT DOCUMENTS

| | | | |
|---|---|---|---|
| 2,781,811 | 2/1957 | Dilar et al. . | |
| 2,868,255 | 1/1959 | Fancher . | |
| 2,911,025 | 11/1959 | Paros . | |
| 3,750,731 | 8/1973 | Brimmell . | |
| 3,924,669 | 12/1975 | Price . | |
| 3,954,129 | 5/1976 | Rudell et al. . | |
| 4,054,166 | 10/1977 | Burke . | |
| 4,206,795 | 6/1980 | Regan . | |
| 4,384,604 | 5/1983 | DeLaura et al. . | |
| 4,799,520 | 1/1989 | Blackburn et al. . | |
| 4,899,878 | 2/1990 | Lofton | 206/423 |
| 5,240,112 | 8/1993 | Neburger | 383/3 |
| 5,291,999 | 3/1994 | Phair | 206/423 |
| 5,323,558 | 6/1994 | Baumier . | |
| 5,590,775 | 1/1997 | Moore | 206/423 |

*Primary Examiner*—Jacob K. Ackun
*Attorney, Agent, or Firm*—Keith S. Bergman

[57] ABSTRACT

A flexible bag formed of gas impervious sheet plastic provides a pneumatically sealable chamber that may be evacuated about the peripheral surface of a Christmas tree carried in the chamber. The flexible bag provides an elongate plastic zipper in its upper portion for access for tree placement and removal, a sealable vacuum channel for evacuation, a pneumatically sealable bottom orifice for access to the trunk of a contained tree, plural spaced fastening bands to aid maintenance of the collapsed mode of the bag about a tree and paired opposed handles to aid manual manipulation. The bag may be evacuated for Christmas tree transport, placement and disposal and may be collapsed about the base of a Christmas tree on a surface supporting the tree for storage during Christmas tree use.

7 Claims, 1 Drawing Sheet

EVACUATIVE CHRISTMAS TREE CONTAINER

BACKGROUND OF INVENTION

1A. Related Applications

There are no applications related hereto heretofore filed in this or any foreign country.

2B. Field of Invention

This invention relates generally to packaging for containment of Christmas trees, and more particularly to a flexible, gas impervious plastic bag that may be evacuated about a Christmas tree for handling, transport, storage and disposal.

3C. Background and Description of Prior Art

Christmas trees are of such size, configuration and mass as to make their containment in packaging difficult and though Christmas tree packaging of various sorts has been known for some time, it has not come into common use, especially in the retail Christmas tree trade. In the present day Christmas tree wholesale trade, commonly trees are somewhat contained, especially those of higher value such as farm raised trees. The purpose of this containment has been primarily to minimize the bulk of Christmas trees and protect them from damage during shipment and storage. In furtherance of such purpose the containment has generally taken the form of some type of wrapping of the tree with flexible strips, fabric, cord or plastic netting to compress and maintain the branches closer to the trunk than they would be in normal relaxed condition. This type of wrapping for trees in the wholesale trade generally is removed by a retailer prior to display and sale of the trees, as in the wrapped condition the trees cannot be viewed in a relaxed form by a purchaser to allow determination of whether the tree suits the purchaser's particular needs and tastes. This commercial type wrapping of trees requires for its establishment fairly expensive and sophisticated equipment that generally is not available for use in the retail trade, at least within the limits of economic feasibility.

The purpose of Christmas tree packaging in the wholesale trade differs sufficiently from the purposes of such packaging in the retail trade that the wholesale containment methods and materials are not suitable in the retail trade and in general, most Christmas trees sold at the retail level are sold and delivered to a customer without any packaging at all. There are, however, numerous advantages to be gained in containerizing Christmas trees, whether natural or artificial, after their acquisition by an ultimate user. Commonly natural Christmas trees are cut to ready them for the market substantially before the time of their actual merchandising, often up to three months before sale. Such trees, by reason of dehydration or other physiological disruption prior to sale, tend to deteriorate and this deterioration is most commonly manifested by a looseness and ultimate loss of needles. The containment of such needles after acquisition of a Christmas tree by a user, during subsequent transport and use, and for disposition after use provides a substantial purpose for packaging that is not accomplished by wholesale type wrapping.

Another problem arises in dealing with Christmas trees after their retail acquisition in that they are difficult to manually manipulate and support during transport, positioning for use and disposal. The average Christmas tree for home use is relatively large, heavy and difficult to grasp and if containerized in an ordinary loosely fitting flexible bag, these problems are only accentuated. For practical utility, a Christmas tree bag must provide means to aid manual manipulation which in the instant bag takes the form of paired opposed handles in the medial portion of the bag for use by one or two persons manipulating the bag with a tree in it.

The shape and size of Christmas trees vary and any container that is to have economic feasibility must be adaptable for use with a substantial number of trees of varying size and configurational parameters. Containers, however, if too large, tend to be more easily damaged by tearing, puncturing, stretching or otherwise during manipulation. The instant container resolves this problem by providing a containment bag that defines a chamber that is gas impervious so that a vacuum may be created in the chamber to allow ambient air pressure to compress the bag about a Christmas tree contained in the chamber. This type of vacuum compression of a containing bag also tends to compress the peripheral portions of branches into a more compact mass about the trunk of the tree, and this compression may be substantial if the packaging material is of sufficient strength and sufficient vacuum is created within the chamber of the packaging. The bag also provides spaced fastening bands to aid in maintenance of the compressed configuration after its initial establishment.

The evacuation of a packaging bag about a Christmas tree may provide additional benefits. A Christmas tree in a decorated condition may be contained in an evacuated bag with the decorations remaining in place on the tree for either storage or transport, and in general the decorations and ornaments will be maintained in their placement positions, depending somewhat upon the extent of the evacuation of the bag and its fit about the tree. This is important in the retailing trade where predecorated Christmas trees are sold, as a purchaser may transport such trees and position them for display by use of the instant bag without materially displacing the ornamentation from its position that existed when the packaging was established. Additionally in the case of artificial Christmas trees, decorations may be left on a tree after its Christmas use and the tree subsequently contained in a bag of the instant invention to allow transport and covered storage without disturbing the ornamentation. Such a stored tree may even be maintained in its evacuated configuration to aid positional maintenance of ornamentation during storage if the vacuum be periodically restored when necessary, the packaged tree be tied in the evacuated configuration or both.

In distinguishment from prior bag type Christmas tree containers, the instant packaging provides a gas impervious bag having orifices sealable by plastic zippers to create an internal chamber that may be evacuated and retain a vacuum for substantial periods of time. A vacuum channel is provided that communicates through a plastic zipper with the internal chamber of the bag so that a vacuum source such as an ordinary vacuum cleaner or other gas pump device may be easily interconnected to evacuate the bag chamber and the vacuum channel thereafter may be sealed without loss of vacuum.

Our invention lies not in any one of these features individually, but rather in the synergistic combination of all of its structures that necessarily give rise to the functions flowing therefrom as specified and claimed.

SUMMARY OF INVENTION

Our Christmas tree container provides a flexible gas impervious plastic bag with a bottom communicating with a body of cylindrical shape which communicates with a wedge shaped upper transition portion that has a plastic zipper at the uppermost apex of the wedge for access to the chamber enclosed by the bag. The bottom defines a bottom orifice closable by a gas impervious plastic zipper for access to a tree trunk for installation of a tree support and a vacuum orifice with a flexible gas impervious vacuum channel, having a gas impervious plastic zipper in its medial portion to create a gas seal, extending spacedly therefrom for interconnection with a vacuum source. The axially medial portions of the bag carry similar diametrically opposed handle structures to aid manipulation and plural spaced fastening bands extend horizontally about the bag to aid in maintaining the evacuated configuration of the bag about a tree.

In providing such packaging, it is:

A principal object to create a flexible gas impervious plastic bag defining a medial chamber that may be evacuated to collapse the bag about a Christmas tree carried in the chamber.

A further object is to provide such a bag that has an upper orifice closed by an elongate plastic zipper that is openable to define an orifice to allow access to the internal bag chamber for placement and removal of a Christmas tree and a second similar orifice in the bottom to allow access the trunk of a contained tree.

A still further object is to provide such a bag that defines a vacuum orifice having a flexible gas impervious vacuum channel thereabout with a plastic zipper in the portion of the channel to aid interconnection of the internal chamber of the bag with a vacuum source.

A still further object is to provide such a bag that has spaced fastening bands extending thereabout to aid in maintaining the collapsed configuration of the bag.

A still further object is to provide such a bag that has paired opposed handle structures to aid manual manipulation of the bag when carrying a Christmas tree.

A still further object of our invention is to provide such a Christmas tree bag that is of new and novel design, of rugged and durable nature, of simple and economic manufacture and one otherwise well adapted for the uses and purposes for which it is intended.

Other and further objects of our invention will appear from the following specification and accompanying drawings which form a part hereof. In carrying out the objects of our invention, however, it is to be remembered that its accidental features are susceptible of change in design and structural arrangement, with only one preferred and practical embodiment being illustrated and specified as is required.

BRIEF DESCRIPTION OF DRAWINGS

In the accompanying drawings which form a part hereof and wherein like numbers of reference refer to similar parts throughout.

DESCRIPTION OF PREFERRED EMBODIMENT

Figures 1, 2, 3, 4, 5:
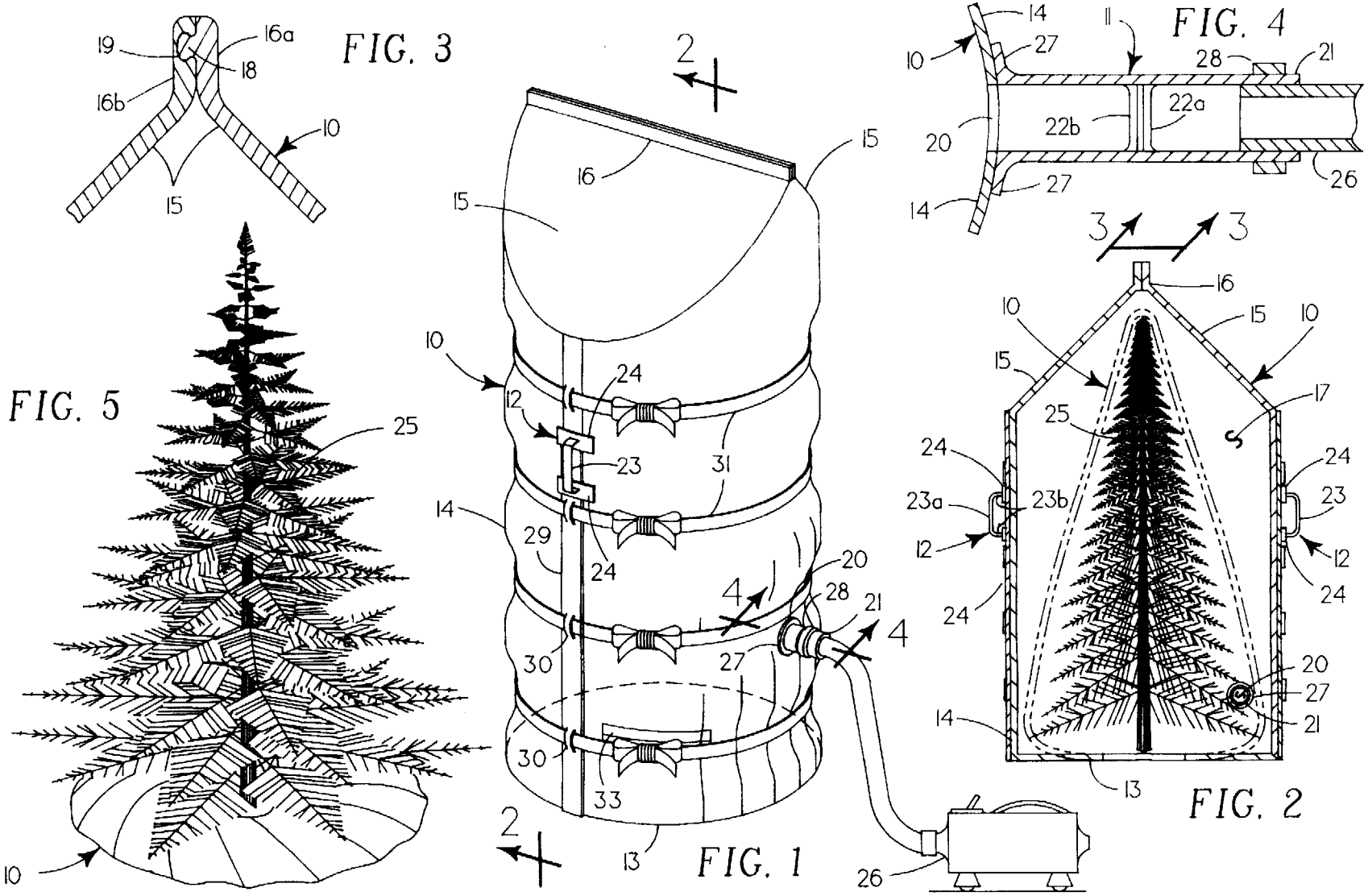
FIG. 1 is an isometric view of our bag in expanded mode to show its various elements, their configuration and relationship.
FIG. 2 is a vertical cross-sectional view through the bag of FIG. 1 having illustratively exaggerated thickness, taken on the line 2—2 on FIG. 1 in the direction indicated by the arrows, with a Christmas tree shown in the bag and a collapsed position of the bag shown in dashed outline.
FIG. 3 is an enlarged partial vertical cross-sectional view through the top plastic zipper of the bag of FIG. 2, taken on the line 3—3 thereon in the direction indicated by the arrows.
FIG. 4 is an enlarged vertical elongate cross-sectional view through the vacuum channel of the bag of FIG. 1, taken on the line 4—4 thereon in the direction indicated by the arrows.
FIG. 5 is an isometric view of a Christmas tree in display mode with our containment bag in stored position about the base of the tree.

Our evacuative container generally provides bag 10 having evacuating structure 11 and handle structure 12.

Bag 10 is peripherally formed by flexible sheet material with an expanded configuration, as illustrated in FIG. 1, providing flat bottom 13, cylindrical body 14 and planar wedge-shaped upwardly tapering transition elements 15 communicating with elongate plastic zipper 16 all combining to enclose internal chamber 17. The size and configuration of bag 10 must be such as to allow containment of a Christmas tree to be enclosed within internal chamber 17. For ordinary room sized Christmas trees this requires a vertical height between bottom 13 and plastic zipper 16 of approximately six to seven feet and a diameter of cylindrical body 14 of approximately the same length, with angulated transition elements which, when combined with the cylindrical body, allow containment of a Christmas tree of ordinary tapering configuration within the internal chamber 17.

Plastic zipper 16 is one of the various types of such devices known in the packaging art for the pneumatic sealing of openings in containers. The particular plastic zipper illustrated in cross-section in FIG. 3 provides adjacent interfitting linear zipper elements **16*a* and 16*b* with the end portions of their adjacent surfaces fastened together. The element 16*a* defines a protruding elongate ridge 18 of bulbously enlarged cross-sectional configuration that fits into cooperatingly configured elongate channel 19 defined from the adjacent surface inwardly into zipper element 16*b* to form an impervious pneumatic seal between the elements 16*a*, 16*b*. This form of plastic zipper illustrated is of a simplistic nature and various other known zippers of more sophisticated nature are adaptable to the uses and purposes of our invention so long as they pneumatically seal the orifice in the bag defined by the zipper elements 16*a*, 16*b***.

Bottom 13 of the bag carries pneumatically sealable plastic zipper 33 that is of a nature similar to the zipper 16 to enclose an orifice defined in the bottom. This orifice allows access to the lower portion of the trunk of a Christmas tree enclosed in the bag for installation of a stand on the tree trunk if one has not been previously installed on the contained tree.

The bag 10 is formed of flexible sheet plastic material of a non-porous nature that is impermeable to gas. The material preferably is at least semi-transparent to allow a user to view bag contents during bag use and if desired the bag may be colored or patternated preferably by materials that preserve at least semi-transparency. The thickness and associated resultant strength of the plastic material may vary with different desired uses of the bag, but in general for Christmas trees of ordinary room size a polyethylene or polyurethane plastic of approximately five to ten mills thickness provides sufficient strength to prevent accidental tears and ruptures by portions of a contained tree or ornaments or decorations carried on the tree during evacuation and handling. A bag to be used for tree disposal is preferably of a biodegradable nature.

Though a particular configuration of bag is illustrated and described, this configuration is not critical and other configurations that fulfill the purpose of enclosing a Christmas tree and associated stand, if involved, within its internal chamber to allow evacuation about the contained objects are within the ambit and scope of our invention. Configurational variations in such bags, especially as heretofore known for better fitting containment of trunks, stands and the like are therefore within the ambit and scope of our invention.

Vacuum structure 11 provides orifice 20 defined in bag 10, in the instance illustrated in the lower medial portion. Vacuum channel 21 is a tubular element having radially outwardly extending fastening flange 27 in its inner end portion to interconnect with the adjacent outer surface of bag 10 about the periphery of vacuum orifice 20 to form a pneumatic seal. This interconnection is accomplished by traditional sheet plastic fastening methods heretofore known such as adhesion, chemically induced cohesion, thermal welding or the like. The vacuum channel 21 extends spacedly from bag 10 to allow interconnection with a vacuum source, such as the conduit of a vacuum cleaner, which may be interconnected by fastening the end portion of the vacuum channel thereabout by means of an elastic band 28 or some similar releasable fastening device, or if desired a specifically designed connector may be interconnected with the outer end portion of the vacuum channel for such communication.

The medial portion of vacuum channel 21 carries plastic zipper 22 formed by lineal diametrically opposed zipper portions 21*a* and 22*b* interconnectable with each other to form a pneumatic seal to close vacuum channel 21 and prevent passage of air therethrough. This plastic zipper 22 is of a nature similar to that illustrated for zipper 16, or may be of various other similar types that accomplish a pneumatic seal, so that after the chamber 17 of the bag 10 is evacuated the plastic zipper 22 may be closed by engagement of its parts to maintain vacuum within internal chamber 17 and allow removal of the vacuum source.

The bag preferably has similar diametrically opposed, vertically orientated strengthening strips 29 interconnected to the exterior surface. These strips 29 define plural spaced parallel slits that define loops 30 therebetween to receive horizontal fastening bands for positional maintenance and also aid the more secure interconnection of handle structures. The strengthening strips are formed of flexible material similar to that of the bag and are interconnected to the bag by known plastic joining methods.

Handle structure 12 provides elongate U-shaped handle 23 having a longer body 23*a* and shorter spaced, perpendicularly extending parallel legs 23*b* at each end. The end of each leg distal from the body interconnects fastening tab 24 which extends over and is structurally interconnected to the outer surfaces of strengthening strip 29 and bag 10 by known plastic connecting means such as adhesion, chemically induced cohesion, plastic welding or the like. The handle 23 is of appropriate size to provide necessary strength and preferably semi-rigidity for configurational maintenance to aid use of the handle. The fastening tabs 24 have sufficient areal extent to allow an interconnection with the strengthening strip and bag that distributes forces between the interconnected structures over a wider area then would the ends of handle legs 23*b*, to provide a stronger and more serviceable joinder of the handle structure to the bag. Preferably our bag 10 has two handle structures arrayed in vertically medial positions on the strengthening strips and the bag, normally radially spaced from the vacuum structure to aid in preventing interference with that structure during bag handling and manipulation.

Plural axially spaced fastening bands 31 extend about the periphery of the bag in an orientation substantially perpendicular to the strengthening strips to aid in maintaining the bag in a collapsed evacuated mode about a contained tree. Each of these bands is positionally maintained on the bag by extension through pairs of opposed loops 30 defined by the opposed strengthening strips 29. The ends of each fastening band are releasably fastened to each other by known fastening means, in the instance illustrated by knots created in the adjacent end portions of each band. The fastening bands are formed of strips of flexible material of appropriate strength to accomplish their purpose, preferably a plastic similar to that from which the bag is formed.

Having thusly described the structure of our bag and its elements, its use may be understood.

A bag created according to the foregoing specification is generally most easily established about a Christmas tree by placing the bag in a collapsed condition on a supporting surface such as a floor with the top portion of the bag and plastic zipper 16 uppermost. The plastic zipper 16 is opened and maintained in an opened condition. A tree is placed in normal upright orientation in the orifice formed by the open plastic zipper 16 with the tree trunk and a stand, if it have an attached stand, supported on the upper surface of bottom 13 of the bag. The upper portion of the bag then is manually moved upwardly about the tree until it is above the tree top. While maintaining this position of the bag, the plastic zipper 16 is closed by appropriate manual pressure to support the bag about the tree and enclose it in the internal chamber. The zippered orifice 33 in the bottom of the bag is closed if this orifice is not previously in such state.

A source of vacuum is attached to vacuum channel 21, in the instance illustrated a vacuum cleaner 26. This interconnection may be accomplished by various known means, but is easily established by moving the outer end portion of vacuum channel 21 about the hose or end fixture of the vacuum cleaner and attaching it thereabout by an elastic element such as rubber band 28. Various particularly designed pneumatically impervious connecting structures may be used for this purpose and are within the ambit and scope of our invention.

The plastic zipper 22 in the vacuum channel is opened, if it is not in that condition, and the operation of the evacuating mechanism is instituted to remove air from the internal chamber 17 of the bag. The evacuation is continued until the bag is appropriately collapsed, by reason of the ambient air pressure thereabout, upon the peripheral surface of the contained Christmas tree. When evacuation is completed, plastic zipper 22 is closed to seal vacuum channel 21 and the interconnection with the evacuating mechanism is disestablished. The fastening bands 31 then are positioned about the collapsed bag and fastened to aid in maintaining the collapsed configuration of the bag about the contained tree. Our bag then is ready for use in storing or transporting the contained Christmas tree.

The amount of vacuum created in the internal chamber 17 of our bag may vary substantially, depending upon the nature and desired results of containment of a particular tree and the ability of the vacuum source. In general, however, because of the flexible and readily deformable nature of bag 10, the vacuum in its internal chamber need not be very great to collapse the bag about the periphery of a Christmas tree. A vacuum of two or three pounds per square inch is adequate for this purpose and vacuum in this range is readily accomplished with ordinary vacuum cleaners of present day commerce.

Most vacuum cleaners have vacuum ports and connecting attachments so that they may easily serve as a vacuum source. Other types of evacuating devices such as are common for evacuating plastic food bags and the like are usable with our bag, though some such devices may be capable of creating vacuums of greater magnitude than are required for our bag. An excessive amount of vacuum may not be desirable because it may cause physical damage to the bag as with such vacuum the bag is more severely compressed about the periphery of a tree and the bag may not have as long a useful life as if it were used with lesser vacuum because of puncturing, teaching, leakage at sealed orifices, leakage through the bag membrane and the like.

It is to be noted that our bag may be established about a Christmas tree for transport to a use location and thereafter lowered about a Christmas tree to a position on the surface supporting the tree where it can remain during the period of tree use, so that it will be readily available after the period of tree use for re-establishment about the tree for further transport for disposal or storage. During the Christmas tree use period, needles or other arboreal or ornamental debris that has accumulated on the bag may be placed in the bag for future disposal without contaminating the areas through which the contained tree is transported.

It is to be further noted that if a tree contained in our bag does not have a stand, the trunk may be accessed through the zippered opening 33 defined in the bag bottom for placement of a stand before positioning the tree in a vertical position for use.

The foregoing description of our invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described our invention, what we desire to protect by letters patent, and

What we claim is:

1. An evacuative Christmas tree container, comprising in combination:

a flexible, gas impervious bag defining a pneumatically sealable internal chamber to contain a Christmas tree and having a bottom, an elongate body and an upper transition element communicating with an upper orifice having a plastic zipper openable for access to the internal chamber and closable to form a pneumatically sealed orifice;

handle structure carried by the bag with at least one elongate U-shaped handle interconnected with the outer surface of the bag; and vacuum structure carried by the bag defining a vacuum orifice in the bag and having a vacuum channel carried by the bag about the vacuum orifice to extend spacedly distant from the bag to interconnect a vacuum source and a plastic zipper in the medial portion of the vacuum channel to allow opening and closing of the vacuum channel to provide a pneumatic seal therein.

2. The evacuative Christmas tree container of claim 1 having paired opposed strengthening strips structurally joined to the outer surface of the bag body in substantially parallel vertical array.

3. The evacuative Christmas tree container of claim 2 further characterized by the strengthening strips each defining one of a pair of similar spaced loops to receive and positionally maintain a fastening band, and a plurality of flexible fastening bands extending through each pair of spaced loops for fastening about a tree contained in the bag to aid in maintaining the bag in an evacuated configuration about the contained tree.

4. The evacuative Christmas tree container of claim 2 having two handle structures each carried on a strengthening strip in a vertically medial portion thereof.

5. The evacuative Christmas tree container of claim 1 enclosing a Christmas tree in combination with a vacuum source releasably interconnected with the vacuum channel to evacuate the internal chamber of the bag to cause collapse of the bag about the periphery of the Christmas tree by reason of ambient air pressure.

6. An evacuative container for Christmas tree storage and transport, comprising in combination:

a relatively thin flexible bag formed of gas impervious polymeric material, with a flat bottom communicating with an upstanding cylindrical body having an inwardly tapering wedge-shaped upper transition portion defining an upper orifice carrying an elongate plastic zipper to define a pneumatically sealable internal chamber to carry a Christmas tree, said bag having vacuum structure with a vacuum orifice defined in the bag and a vacuum channel sealably communicating with the bag about the vacuum orifice to extend spacedly therefrom for releasable connection with a vacuum source, said vacuum channel having a plastic zipper in its medial portion to provide a releasable pneumatic seal in the vacuum chamber, paired opposed strengthening strips structurally carried by the outer surface of the bag body, each strengthening strip defining one of a plurality of pairs of vertically spaced loops to receive and positionally maintain flexible fastening bands, plural flexible fastening bands having two ends and extending between each pair of loops defined in the strengthening strips and about the bag, each fastening band having means for releasable fastening of the ends together in adjustable relationship, and paired opposed handle structures, each having a handle with a body and similar perpendicularly extending legs carrying fastening tabs at the end portions of the legs distal from the body, structurally carried in a medial position on each of the strenghtening strips.

7. The evacuative container of claim 6 having a pneumatically sealable orifice defined in the bottom for access to the trunk of a Christmas tree contained in the evacuative container.

* * * * *